United States Patent [19]

Khe et al.

[11] Patent Number: 4,868,079

[45] Date of Patent: Sep. 19, 1989

[54] INFRARED-SENSITIVE ELECTROPHOTOCONDUCTIVE ELEMENT COMPRISING AN ANTHANTHRONE, A PHTHALOCYANINE AND AN OXADIAZOLE COMPOUND IN ADMIXTURE

[75] Inventors: Nguyen C. Khe, Rochester, N.Y.; Masanobu Nakamura, Saitama, Japan; Midori Fukawatase, Tokyo, Japan; Kenji Takahashi, Tokyo, Japan

[73] Assignee: Dainippon Ink and Chemicals, Inc., Tokyo, Japan

[21] Appl. No.: 183,394

[22] Filed: Apr. 13, 1988

Related U.S. Application Data

[63] Continuation of Ser. No. 18,556, Feb. 25, 1987, abandoned.

[30] Foreign Application Priority Data

Feb. 27, 1986 [JP] Japan ..... 61-42141

[51] Int. Cl.[4] ..... G03G 5/06

[52] U.S. Cl. ..... 430/72; 430/74; 430/77; 430/78

[58] Field of Search ..... 430/72, 74, 77, 78

[56] References Cited

U.S. PATENT DOCUMENTS 3,894,869 7/1975 Goffe ..... 430/45

*Primary Examiner*—J. David Welsh

*Attorney, Agent, or Firm*—Armstrong, Nikaido, Marmelstein, Kubovcik & Murray

[57] ABSTRACT

An electrophotoconductor is disclosed, comprising a conductive support having provided thereon a photoconductive layer comprising a resin binder having dispersed therein an anthanthrone compound, a phthalocyanine compound, and an oxadiazole compound. The electrophotoconductor exhibits high sensitivity in the wavelength region of from 760 to 850 nm and high negative charge retention and is suitable for use in a recording device using a semiconductor laser as a light source.

7 Claims, No Drawings

INFRARED-SENSITIVE ELECTROPHOTOCONDUCTIVE ELEMENT COMPRISING AN ANTHANTHRONE, A PHTHALOCYANINE AND AN OXADIAZOLE COMPOUND IN ADMIXTURE

This application is a continuation of application Ser. No. 018,556 filed Feb. 25, 1987, now abandoned.

FIELD OF THE INVENTION

This invention relates to an electrophotoconductor having high sensitivity in the near infrared region which is suitable for use in electrophotographic devices, and particularly, recording devices employing a semiconductor laser as a light source for recording, such as a laser beam printer, a laser printing plate making system, and the like.

BACKGROUND OF THE INVENTION

In an electrophotographic recording system, a light source for recording is chosen according to spectral sensitivity of a photoconductor used. Systems using a gas laser, e.g., an Ar laser, an He-Ne laser, etc., as a light source for recording achieves image formation in a relatively short time because of the high output of the laser. However, since use of a gas laser is associated with a complicated optical system and requires techniques for maintenance therefor, it is difficult to reduce the size and cost of devices. Therefore, studies are being made on a recording system using a semiconductor as a light source which would meet the demands for small-sized and unexpensive devices.

Semiconductor lasers have recently received a marked development. Of conventionally proposed semiconductor lasers, those having their oscillation wavelengths in the region longer than 780 nm have been put into practical use. For particular use in printers or printing plate making systems, semiconductor lasers having their oscillation wavelengths in the region of from 780 nm to 850 nm are commonly employed.

Since state-of-the-art semiconductor lasers have lower outputs than other lasers, photoconductors to be used in semiconductor laser printers, semiconductor laser printing plate making systems, etc. are required to have sufficiently high sensitivity in the wavelength region of from 780 to 850 nm. For practical purposes, sensitivities of 10 erg/cm$^2$ or less in terms of $E_{\frac{1}{2}}$ (exposure required to reduce the charge by half its initial value) are demanded.

Known electrophotoconductors include those containing inorganic compounds, e.g., zinc oxide, copper phthalocyanine compounds, oxadiazole compounds, etc., as photosensitive substances, but none of them exhibits sufficiently high sensitivity in the longer wavelength region of from 780 to 850 nm.

SUMMARY OF THE INVENTION

Accordingly, one object of this invention is to provide an electrophotoconductor having high sensitivity in the longer wavelength region and suitable for use in recording devices using a semiconductor laser as a light source for recording.

It has now been found that the above object can be accomplished by an electrophotoconductor comprising a conductive support having provided thereon a photosensitive layer in which (a) an anthanthrone compound, (b) a phthalocyanine compound, and (c) an oxadiazole compound are dispersed in (d) a resin binder.

DETAILED DESCRIPTION OF THE INVENTION

The anthanthrone compound which can be used in the present invention may be selected arbitrarily from compounds known to have electrophotoconductivity, such as anthanthrone, dibromoanthanthrone, dichloroanthanthrone, dimethoxyanthanthrone, diethoxyanthanthrone, C.I. VAT Black 29, iodized dibromoanthanthrone, etc. Particularly preferred among them are compounds represented by formula

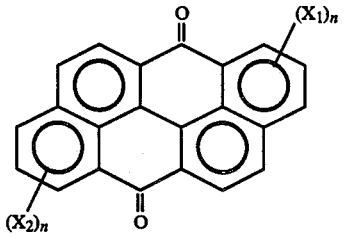

(I)

wherein $X_1$ and $X_2$ each represents a halogen atom; and n represents 0 or an integer of from 1 to 4.

The phthalocyanine compound which can be used in the present invention includes metallo-phthalocyanine or metal-free phthalocyanine compounds and derivatives thereof with the aromatic nucleus being substituted. Examples of preferred phthalocyanine compounds include metallo-phthalocyanine compounds having formulae (II) to (VI) shown below, in which at least part of the four benzene nuclei may be substituted by a halogen atom, a nitro group, an amino group, a substituted or unsubstituted alkyl group, a substituted or unsubstituted aralkyl group, or a substituted or unsubstituted aryl group.

(II)

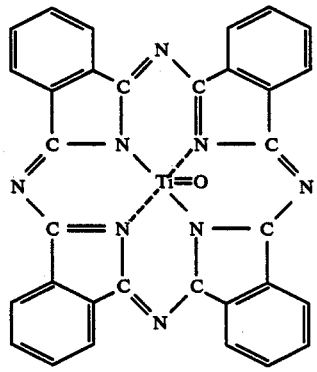

-continued (III)

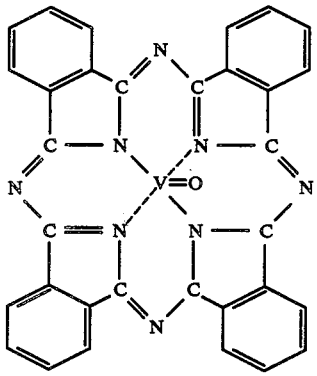

(IV)

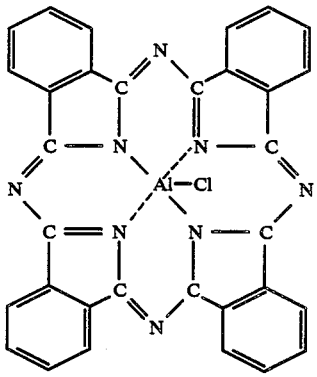

(V)

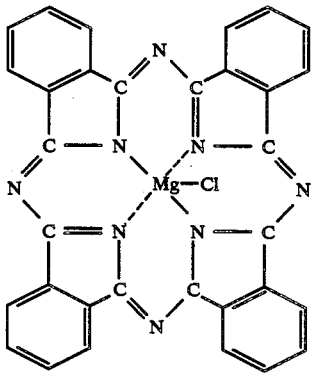

(VI)

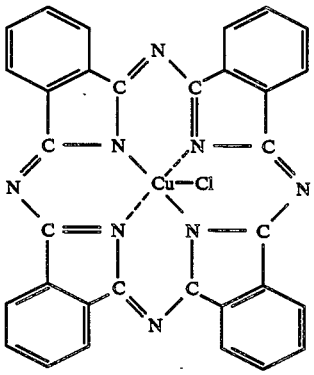

The oxadiazole compound which can be used in the present invention may be selected arbitrarily from conventional oxadiazole compounds known to have electrophotoconductivity, such as 2,5-bis(4-dimethylaminophenyl)-1,3,4-oxadiazole, 2,5-bis(4-diethylaminophenyl)-1,3-4-oxadiazole, 2,5-bis(4-dipropylaminophenyl)-1,3,4-oxadiazole, 2,5-bis(4-aminophenyl)-1,3,4-oxadiazole, 2-(4'-aminostyryl)-5-phenyl-1,3,4-oxadiazole, 2-(4'-aminostyryl)-5-(4''-methylphenyl)-1,3,4-oxadiazole, etc. Particularly preferred among them are those represented by formula (VII)

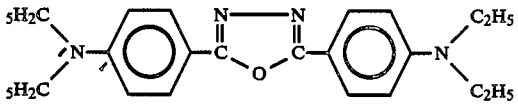

The oxadiazole compound of formula (VII) may be used in combination with an N-alkylcarbazole compound, e.g., N-methylcarbazole, N-ethylcarbazole, N-propylcarbazole, etc., or a dialkylaminobenzoic acid compound, e.g., dimethylaminobenzoic acid, diethylaminobenzoic acid, dipropylaminobenzoic acid, etc.

The binders to be used in the photosensitive layer of the invention are not particularly restricted, and any known binder resin commonly employed in electrophotographic materials can be selected. Examples of preferred resins to be used as binders include acrylic resins, polyester resins, polycarbonate resins, polystyrene resins, phenolic resins, epoxy resins, urethane resins, phenoxy resins, and the like.

The electrophotoconductors according to the present invention can be prepared by dissolving a resin binder in an appropriate organic solvent, uniformly dispersing the aforesaid compounds (a) to (c) in the binder solution by means of a ball mill, a paint shaker, a sand mill, a ultrasonic dispersing machine, etc. to prepare a coating composition, and coating the composition on a conductive support, followed by drying. Coating is usually carried out by roll coating, wire bar coating, doctor blade coating, and the like.

Solvents which can be used for dissolving the binder include aromatic hydrocarbons, e.g., benzene, toluene, etc.; ketones, e.g., acetone, butanone, etc.; halogenated hydrocarbons, e.g., methylene chloride, chloroform, etc.; ethers, e.g., ethyl ether, etc; cyclic ethers, e.g., tetrahydrofuran, dioxane, etc.; and esters, e.g., ethyl acetate, methyl cellosolve acetate, etc. These solvents may be used either alone on in combination of two or more thereof.

The photosensitive layer is preferably coated to a dry thickness of from 3 to 50 μm, and more preferably from 3 to 15 μm.

In the photosensitive layer, the anthanthrone compound (a) and the phthalocyanine compound (b) each is preferably used in an amount of from 0.5 to 90% by weight, and more preferably from 10 to 40% by weight, based on the resin binder (d). The oxadiazole compound (c) is preferably used in an amount of from 0.1 to 90% by weight, and more preferably from 1 to 80% by weight, based on the resin binder (d).

The conductive support on which a photosensitive layer is formed usually includes a metal sheet or foil, e.g., an aluminum sheet or foil, a plastic film having deposited thereon a metal, e.g., aluminum, and paper having been rendered electrically conductive.

If desired, an adhesive layer or a barrier layer may be provided between the conductive support and the photosensitive layer. Materials for the adhesive or barrier layer include polyamide, nitrocellulose, casein, polyvinyl alcohol, etc.

A laser printing plate making system has been developed, in which a printing plate is produced by using an electrophotoconductor having high sensitivity to laser beams, and has already been applied to practical use in U.S.A. The electrophotoconductors in accordance with the present invention can be suitably utilized in this system because of their high sensitivities to laser beams. For use in this system, a metal sheet, and preferably an aluminum sheet, having a grain surface is used as a conductive support, and an alkali-soluble resin is used as a binder. The alkali-soluble resin includes a styrene-maleic acid copolymer, a copolymer of a polymerizable monomer (e.g., acrylic esters, methacrylic esters, vinyl acetate, styrene, vinyl chloride, etc.) and a carboxyl-containing polymerizable monomer (e.g., acrylic acid, methacrylic acid, maleic acid, fumaric acid, itaconic acid, etc.), and the like. The photoconductor prepared by using these materials is irradiated with a laser beam to form a toner image thereon. After fixation of the toner image, the photoconductor is developed with an aqueous alkali solution containing an alkali agent (e.g., sodium hydroxide, sodium silicate, etc.) whereby non-image areas are dissolved and removed, while the toner image remains. On printing, the remaining toner image serves as image areas, and the exposed metal surface forms non-image areas. The thus produced printing plate can be used as a lithographic printing plate using fountaining solution.

The sensitization mechanism of the electrophotoconductor according to the present invention will be briefly explained below.

Conventionally reported phthalocyanine compounds are hole transport substance. A photosensitive layer obtained by uniformly dispersing such a phthalocyanine compound in a resin binder shows satisfactory sensitivity only when positively charged but has an inferior charge retention when negatively charged because it receives injection and transport of holes from the support electrode. Such behavior is unfavorable particularly in the laser scan plate making system. Even if the phthalocyanine compound is dispersed in an ordinary charge carrier transporting material, such as a hole transport substance, e.g., oxadiazole compounds, hydrazone compounds, pyrazoline compounds, etc., it has a considerably high residual potential when negatively charged.

To to contrary, the system according to the present invention in which an appropriate amount of an anthanthrone compound is added to a phthalocyanineoxadiazole system, i.e., a phthalocyanine hole transporting material system, exhibits surprisingly improved negative charge retention and increased sensitivity, thus realizing a single-layer photoconductor which shows high sensitivity even when negatively charged.

Considering the fact that an anthanthrone compound-oxadiazole-resin binder dispersion system photoconductor containing no phthalocyanine compound exhibits substantially no sensitivity in the wavelength region longer than 780 nm, it is believed that in the photoconductor of the invention an electronical interaction is produced among the three components, i.e., anthanthrone compound, phthalocyanine compound, and oxadiazole compound, and the phthalocyanine compound is excited to generate the transport charge carriers thereby to show high sensitivity.

The present invention will now be illustrated in greater detail by way of examples, but it should be understood that the present invention is not limited thereto. In these examples, all the parts are by weight unless otherwise indicated.

EXAMPLE 1

A mixture consisting of 120 parts of dibromoanthanthrone of formula

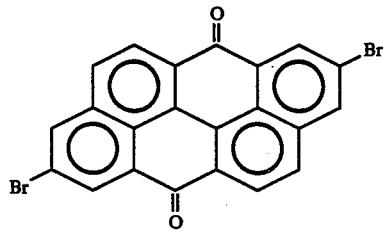

10 parts of titanyl phthalocyanine of formula (II), 150 parts of the oxadiazole compound of formula (VII), 660 parts of a polyester resin as a binder ("Vylon 200" produced by Toyo Spinning Co., Ltd.), and 5500 parts of a methyl ethyl ketone-methylene chloride mixed solvent was uniformly dispersed in a paint shaker. The resulting coating composition was coated on an aluminum sheet with a wire bar coater, followed by drying to prepare a photoconductor having a 13 μm thick photosensitive layer. The resulting electrophotoconductor was determined for charging characteristics and photosensitivity according to the following procedures by means of "Paper Analyzer SP-428" manufactured by Kawaguchi Electric Works Co., Ltd.

The photoconductor was charged to a negative voltage of 6 kV, and the surface potential immediately after charging (initial potential: $V_0$) and after 10 seconds from the charging ($V_{10}$) were measured to obtain a surface potential retention ($V_{10}/V_0$). The photoconductor was then exposed to white light emitted from a tungsten lamp at an illumination of 5 lux, and the photosensitivities $E_{\frac{1}{2}}$ and $E_{1/5}$ (lux·sec), i.e., the exposure required for the surface potential to drop to half or one-fifth of the initial value, were measured. Further, the surface potential retained after 15 seconds from the commencement of exposure ($V_R15$) was measured. In the same manner, the spectral photosensitivity $E_{\frac{1}{2}}$ ($\mu J/cm^2$) of the photoconductor when exposed to light of 830 nm was measured. Evaluation of photosensitivity of the photoconductor was made based on these measured values. The results obtained are shown in Table 1.

COMPARATIVE EXAMPLES 1 TO 3 AND EXAMPLES 2 TO 5

Photoconductors were produced in the same manner as described in Example 1 except for using compositions shown in Table 1. The resulting photoconductors were evaluated in the same manner as in Example 1, and the results obtained are shown in Table 1.

TABLE 1

| | Example 1 | Comparative Example 1 | Comparative Example 2 | Comparative Example 3 | Example 2 | Example 3 | Example 4 | Example 5 |
|---|---|---|---|---|---|---|---|---|
| Composition (part): | | | | | | | | |
| Dibromoanthanthrone | 120 | 120 | — | — | 120 | 120 | 120 | 120 |

TABLE 1-continued

| | Example 1 | Comparative Example 1 | Comparative Example 2 | Comparative Example 3 | Example 2 | Example 3 | Example 4 | Example 5 |
|---|---|---|---|---|---|---|---|---|
| Titanyl Phthalocyanine | 10 | 0 | 10 | 10 | 20 | 30 | 60 | 120 |
| Oxadiazole of (VII) | 150 | 150 | 150 | — | 150 | 150 | 150 | 150 |
| Vylon 200 | 660 | 660 | 660 | 660 | 660 | 660 | 660 | 660 |
| Methyl Ethyl Ketone/ Methylene Chloride | 5500 | 5500 | 5500 | 5000 | 5500 | 5500 | 5500 | 5500 |
| Electrostatic Characteristics: | | | | | | | | |
| $V_0$ (V) | −530 | −600 | −700 | −650 | −630 | −720 | −580 | −430 |
| $V_{10}$ (V) | −500 | −580 | −630 | −600 | −600 | −660 | −520 | −380 |
| $V_{10}/V_0$ | 0.94 | 0.97 | 0.90 | 0.92 | 0.94 | 0.97 | 0.93 | 0.74 |
| $E_{\frac{1}{2}}$ (lux · sec) | 1.8 | 12.0 | 500.0 | 180.0 | 2.0 | 1.80 | 1.40 | 1.40 |
| $E_{1/5}$ (lux · sec) | 2.4 | 24.0 | — | — | 4.5 | 4.0 | 4.0 | 5.0 |
| $V_{R15}$ (V) | 0 | — | — | — | 0 | 0 | 0 | 0 |
| $E_{\frac{1}{2}}$ at 830 nm ($\mu J/cm^2$) | 0.6 | — | — | 60.0 | 0.99 | 0.90 | 0.60 | 0.4 |

EXAMPLE 6

The photoconductor as prepared in Example 1 was determined for sensitivity $E_{\frac{1}{2}}$ in the same manner as in Example 1 except for using monochromatic light having various wavelengths as shown in Table 2 selected by a combination of an interference filter and a band pass filter in place of white light as used in Example 1. The results obtained are shown in Table 2.

TABLE 2

| Wavelength (nm) | $E_{\frac{1}{2}}$ ($\mu J/cm^2$) |
|---|---|
| 400 | 0.7 |
| 450 | 0.70 |
| 480 | 0.80 |
| 500 | 0.81 |
| 520 | 0.80 |
| 560 | 0.90 |
| 580 | 0.92 |
| 600 | 1.0 |
| 630 | 0.9 |
| 660 | 0.8 |
| 700 | 0.75 |
| 750 | 0.75 |
| 780 | 0.70 |
| 800 | 0.65 |
| 830 | 0.68 |
| 850 | 0.65 |
| 890 | 0.68 |

EXAMPLES 7 TO 11

Photoconductors were produced in the same manner as in Example 1 except for replacing the titanyl phthalocyanine as used in Example 1 with compounds shown in Table 3. The resulting photoconductors were evaluated in the same manner as in Example 1, and the results obtained are also shown in Table 3.

TABLE 3

| Example No. | Phthalocyanine Compound | $\lambda_{max}$ | $V_0$ | Dark Decay Rate | $E_{\frac{1}{2}}$ (lux · sec) | $E_{\frac{1}{2}}$ at $\lambda_{max}$ ($\mu J/cm^2$) |
|---|---|---|---|---|---|---|
| 7 | (III) | 810 | −550 | 0.89 | 2.0 | 0.7 |
| 8 | (IV) | 800 | −500 | 0.82 | 2.0 | 0.7 |
| 9 | (V) | 850 | −600 | 0.79 | 2.3 | 0.8 |
| 10 | metal-free phthalocyanine | 780 | −600 | 0.90 | 3.0 | 0.9 |
| 11 | (VII) | 778 | −600 | 0.92 | 6.0 | 1.2 |

EXAMPLE 12

The photoconductor as produced in Example 1 was evaluated for stability on repeated use by means of Paper Analyzer SP-428. The photoconductor was charged to a negative voltage of 6 kV and exposed to light at an illumination of 50 lux. The characteristics in the initial stage and after copying 6000 prints were measured, and the results obtained are shown in Table 4.

TABLE 4

| | $V_O$ (V) | $V_{10}$ (V) | $E_{\frac{1}{2}}$ (lux. · sec) | $E_{1/5}$ (lux.sec) | $V_{15}$ (V) |
|---|---|---|---|---|---|
| Initial State | −530 | −500 | 1.8 | 2.4 | 0.0 |
| After Copying 6,000 Prints | −550 | −500 | 1.7 | 2.2 | 0.0 |

It can be seen from the results of Table 4 that the photoconductor according to the present invention has excellent stability on repeated use.

EXAMPLE 13

A photoconductor was produced in the same manner as in Example 1 except for using a styrene-maleic acid copolymer resin ("ISM-7" produced by Gifu Shellac Seizosho K.K.) as a resin binder and a grained aluminum sheet as a conductive support. As a result of evaluation, the initial potential $V_0$ and photosensitivity $E_{\frac{1}{2}}$ of the resulting photoconductor were found to be 300 V and 2.5 lux.sec, respectively.

An electrostatic latent image was formed on the photoconductor by the use of a laser printing plate making apparatus, and the latent image was developed with a liquid developer ("CBR-100" produced by Dai-Nippon Ink & Chemicals Inc.), followed by heating at 180° C. for 5 seconds to fix the toner image. Then, the photosensitive layer on the areas where a toner was not adhered was removed by dissolving in a mixed aqueous alkali solution of sodium hydroxide and sodium silicate adjusted to a pH of 13 thereby to produce a lithographic printing plate having a toner image thereon. When the resulting printing plate was actually used for printing, more than 100,000 clear prints were obtained.

As described above, the electrophotoconductors in according with the present invention, in which (a) an anthanthrone compound, (b) a phthalocyanine compound, and (c) an oxadiazole compound are incorporated in a photosensitive layer, exhibit markedly increased sensitivity to light of longer wavelengths of from 760 nm to 860 nm and greatly improved negative charge retention. The photoconductors of the invention are, therefore, suitable for use in recording device using a semiconductor laser as a light source for recording.

While the invention has been described in detail and with reference to specific embodiments thereof, it will be apparent to those skilled in the art that various changes and modifications can be made therein without departing from the spirit and scope thereof.

What is claimed is:

1. An electrophotoconductor having high sensitivity in the near infrared region comprising a conductive support having provided thereon a photosensitive layer comprising a resin binder having dispersed therein from 0.5 to 90% by weight of an anthanthrone compound, from 0.5 to 90% by weight of a phthalocyanine compound, and from 0.1 to 90% by weight of an axadiazole compound.

2. An electrophotoconductor as in claim 1, wherein said anthanthrone compound is a compound represented by formula

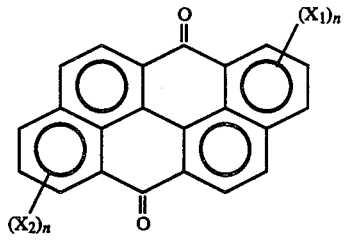

wherein $X_1$ and $X_2$ each represents a halogen atom; and n represents 0 or an integer of from 1 to 4.

3. An electrophotoconductor as in claim 1, wherein said oxadiazole compound is a compound represented by formula

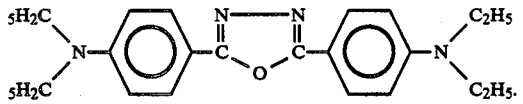

4. An electrophotoconductor as in claim 1, wherein said anthanthrone compound is present in an amount of from 10 to 40% by weight based on the resin binder.

5. An electrophotoconductor as in claim 1, wherein said phthalocyanine compound is present in an amount of from 10 to 40% by weight based on the resin binder.

6. An electrophotoconductor as in claim 1, wherein said oxadiazole compound is present in an amount of from 1 to 80% by weight based on the resin binder.

7. An electrophotoconductor as in claim 1, wherein said conductive support is an aluminum sheet having a grain surface and said resin binder is an alkalisoluble resin.

* * * * *